US007347769B2

(12) United States Patent
Neff

(10) Patent No.: US 7,347,769 B2
(45) Date of Patent: Mar. 25, 2008

(54) METHOD OF FABRICATING PLIANT WORKPIECES, TOOLS FOR PERFORMING THE METHOD AND METHODS FOR MAKING THOSE TOOLS

(76) Inventor: Charles E. Neff, 42770 Mound Rd., Sterling Heights, MI (US) 48314

( * ) Notice: Subject to any disclaimer, the term of this patent is extended or adjusted under 35 U.S.C. 154(b) by 0 days.

(21) Appl. No.: 11/351,842

(22) Filed: Feb. 10, 2006

(65) Prior Publication Data

US 2006/0194524 A1 Aug. 31, 2006

Related U.S. Application Data

(62) Division of application No. 10/635,374, filed on Aug. 6, 2003, now Pat. No. 6,997,790.

(60) Provisional application No. 60/401,816, filed on Aug. 7, 2002.

(51) Int. Cl.
*B24B 1/00* (2006.01)

(52) U.S. Cl. ..... 451/41; 451/177; 451/182; 451/184; 451/296; 451/299; 451/342; 451/367

(58) Field of Classification Search ..... 451/177, 451/182, 184, 296, 299, 840, 847, 342, 347
See application file for complete search history.

(56) References Cited

U.S. PATENT DOCUMENTS 1,628,352 A 5/1927 Bonazzi
1,788,600 A 1/1931 Smyser
1,854,071 A 4/1932 Schacht
2,001,911 A 5/1935 Wooddell
2,015,658 A 10/1935 Bezzenberger
2,076,846 A 4/1937 Johanson
2,077,100 A * 4/1937 Edgar ..... 451/49
2,184,896 A 12/1939 Oglesby
2,198,766 A 4/1940 Gallagher
2,205,939 A 6/1940 Wilson
2,292,261 A 8/1942 Albertson
2,334,494 A 11/1943 Keeleric
2,353,404 A 7/1944 Keeleric
2,367,286 A 1/1945 Keeleric
2,370,970 A 3/1945 Keeleric
2,424,140 A 7/1947 Beecher
2,582,231 A 1/1952 Catallo
2,793,427 A 5/1957 Marvin
2,798,474 A 7/1957 Ballhausen
2,820,746 A 1/1958 Keeleric
2,823,562 A 2/1958 Humbarger
2,876,086 A 3/1959 Raymond
2,904,418 A 9/1959 Fahnoe
2,906,612 A 9/1959 Anthony et al.

(Continued)

FOREIGN PATENT DOCUMENTS

GB 1505923 4/1978

*Primary Examiner*—Joseph J. Hail, III
*Assistant Examiner*—Shantese L McDonald
(74) *Attorney, Agent, or Firm*—Leydig, Voit & Mayer, Ltd

(57) ABSTRACT

An improved method of manufacturing automotive accessory drive belts or other workpieces of pliant material which have a grooved operative face, a tool having an abrasive ramp configuration for performing said improved method and a method of manufacturing said tool with the abrasive ramp configuration.

6 Claims, 17 Drawing Sheets

U.S. PATENT DOCUMENTS 3,048,482 A 8/1962 Hurst
3,073,690 A 1/1963 Hollis et al.
3,090,614 A 5/1963 Freeman
3,102,011 A 8/1963 Bellinger
3,211,634 A 10/1965 Lorenzo
3,306,719 A 2/1967 Fringhian
3,431,105 A 3/1969 Heck
3,625,666 A 12/1971 James
3,894,673 A 7/1975 Lowder et al.
3,898,772 A 8/1975 Sawluk
3,918,217 A 11/1975 Oliver
4,010,583 A 3/1977 Highberg
4,078,906 A 3/1978 Green
4,148,161 A * 4/1979 McCandless et al. ..... 451/334
4,246,004 A 1/1981 Busch
4,288,233 A 9/1981 Wiand
4,389,192 A * 6/1983 Neuwirth ..... 433/166
4,539,017 A 9/1985 Augustin
4,610,698 A 9/1986 Eaton et al.
4,643,740 A 2/1987 Nicolson
4,799,939 A 1/1989 Bloecher
4,916,869 A 4/1990 Oliver
4,977,709 A 12/1990 Siden
5,181,939 A 1/1993 Neff
5,213,590 A 5/1993 Neff
5,489,235 A 2/1996 Gagliardi et al.
5,496,208 A 3/1996 Neff
5,578,099 A 11/1996 Neff
5,704,862 A * 1/1998 Janne et al. ..... 474/168
6,120,568 A 9/2000 Neff
6,361,462 B1 3/2002 Takada et al.

* cited by examiner

METHOD OF FABRICATING PLIANT WORKPIECES, TOOLS FOR PERFORMING THE METHOD AND METHODS FOR MAKING THOSE TOOLS

REFERENCE TO RELATED PATENT APPLICATION

This patent application is a divisional of U.S. patent application Ser. No. 10/635,374 filed on Aug. 6, 2003 now U.S. Pat. No. 6,997,790, which was based on and claimed the benefits of U.S. Provisional Application No. 60/401,816 filed on Aug. 7, 2003.

FIELD OF THE INVENTION

This invention pertains to precision methods for operating on surfaces of pliant non-metallic workpieces, to methods of manufacturing tools for such operations and to tools for performing such operations.

BACKGROUND OF THE INVENTION

Historically, processing pliant materials such as rubber compounds and elastomers has presented serious difficulties. This has been especially true when the processing resembled grinding to shape or finish a part as practiced on hard materials such as metals, thermosetting resins and the like. The resilience of the workpiece has produced a variable and unpredictable interface between workpiece and tool and consequent unpredictable dimensions and surface finish of the workpiece. Furthermore, the nature of the debris from the workpiece produced by a grinding operation on pliant materials presented other serious problems in productivity and product quality. Specifically, using a grinding wheel or similar grinding tool incorporating relatively large abrasive particles on the grinding surface results in excessive forces on the workpiece and consequent distortion of the product during processing, low quality and difficult quality control. On the other hand, smaller abrasive particles that do not abuse the workpiece to the same extent tend to clog the grinding surface which quickly becomes non-functional because of the debris retained on the wheel.

For many grinding applications involving pliant workpieces, a grinding tool made in accordance with Neff U.S. Pat. No. 5,181,939 optimized both the speed with which a workpiece can be finished as well as the quality of the finished product. In accordance with the teaching of the '939 patent, elements of a generally conic configuration made up of many small abrasive particles are held together on a flexible matrix, transferred to a tool blank and brazed in place to form a finished tool. The tool may be in the nature of a hand file, a rotary grinding wheel or other appropriate configurations. The conic elements can be dressed to provide a precision grinding surface and the interstices between the apices of the elements provide the capability of receiving grinding debris and discharging that grinding debris from the working face.

While grinding tools for many applications have been very successful utilizing the teachings of the '939 patent, certain workpieces requiring a relatively high degree of precision and high production rates were not readily produced even with the advantageous processes and products provided by the '939 teaching. However, the teaching of the '939 patent is utilized in the preferred embodiments of the invention described hereinafter and the entire specification and drawings thereof are incorporated herein by reference.

One product that has heretofore escaped the full benefits of the abrasive element and tool construction of the '939 patent are automotive accessory belts and similar pliable products having one or more grooves to receive corresponding ribs in pulleys and the like. Automotive accessory belts have multiple grooves formed in the cross section to receive the ribs on the circumference of multi-rib pulleys that either drive the belt or are driven by the belt to power air conditioning systems, power steering systems and the like. The multiple grooves in automotive accessory belts have been molded, or alternatively, they have been formed in flat belts using grinding or flycutting techniques. Grinding has been achieved using wheels surfaced with small diamond particles and having the profile for the multiple lands and grooves of workpieces formed therein. In flycutting, a term adopted from the metal working industry, tungsten carbide knives are held in a rotating fixture. The knives are ground to produce the desired belt profile.

Both the grinding and flycutting techniques present problems, produce imprecise results and involve short tool life and high cost. In diamond grinding wheels, very fine diamonds must be used to achieve the intricate profile in the belt. Consequently, the material removal rate is limited as are the speeds and feeds. Surface speeds with conventional belts have normally been limited to less than 6,000 feet per minute and the rate at which the belt can be fed is limited to about 90 feet per minute. Flycutting with tungsten carbide knives offers great advantages in productivity. Speeds in the order of 10,000 feet per minute are possible and a feed rate in the order of 5 inches per second has been reported. However, the flycutting tools have very short useful life and frequent resharpening is required. This necessitates constant process monitoring and downtime for removing and replacing tooling. Consequently, tooling costs for both diamond grinding and flywheel cutting have been high.

BRIEF SUMMARY OF THE INVENTION

The present invention provides unique tools and methods for processing pliant workpieces such as automotive accessory belts that have grooves and lands. Tools constructed in accordance with this invention and utilized in accordance with this invention to make pliant workpieces have been reported to provide from 5 to 10 times the life of a diamond grinding tool, to dramatically reduce the process monitoring requirements and downtime for tooling changes and to permit higher production rates. While flycutting with tungsten carbide knives permits production speeds much higher than diamond wheels while running, that process requires frequent monitoring and more frequent downtime for tooling changes. Known prior art techniques and tools were hard on the pliant workpieces. They distorted the workpiece during processing and made dimensional stability and precision workpieces difficult or impossible. Utilizing the present invention, tool speeds of 10,000 feet per minute and feed rates of 10 inches per second have been achieved in production operations with greatly enhanced tool life.

The improved method or process of this invention for manufacturing automotive accessory drive belts or other grooved workpieces involves the use of a unique ramped tool having unique patterns of abrasive elements formed thereon. The tool is manufactured by a unique fabricating process including creation and application of unique elements of abrasive particles secured to a tool blank.

BRIEF DESCRIPTION OF THE DRAWINGS

FIGS. 25-28*a* are reproduced from U.S. Pat. No. 5,181,939 to provide a convenient illustration and description of elements and a method of element manufacture in which:

FIG. 25 shows a fixture for forming abrasive elements;

FIG. 26 shows the fixture with elements of tungsten carbide particles positioned during manufacture;

FIG. 27 shows an enlarged fragment of FIG. 26 showing the inclusion of braze alloy and cement;

FIG. 28 shows the encircled area in FIG. 27 after the firing step is completed; and FIG. 28A is an enlarged fragment of the encircled area 28A in FIG. 28.

DETAILED DESCRIPTION OF THE INVENTION

The invention disclosed herein is set forth in the following description, is illustrated in the attached drawings and is the subject of the attached claims. The invention includes an abrasive tool, a method of making the tool and a method for removing material from a workpiece, especially a pliant workpiece. Material is removed by contact and relative motion between a working surface of the tool and an operative surface of the workpiece in a direction to produce a precision profile comprising an elongate groove configuration in the workpiece. The abrasive tool is especially useful in manufacturing products of compliant rubber-like materials. The method involves removing material from an elongate, non-metallic workpiece to produce a precise operative face with a precision tapered groove, a back face and opposed sides connecting the faces. The particular workpiece selected to illustrate preferred embodiments of the invention hereinafter is an automotive accessory drive belt. The abrasive tool and the method of manufacturing abrasive tools are also described in the context of the method of manufacturing an automotive accessory drive belt. However, the scope of the invention is as set forth in the attached claims and is not limited to the preferred embodiments nor to the exemplary structures and process steps described hereinafter.

Figure 1:
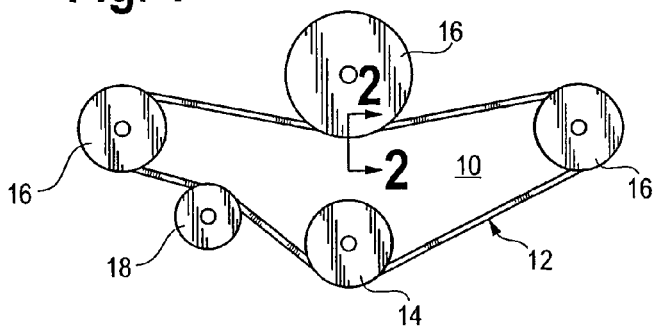
FIG. 1 is a diagrammatic and schematic illustration of an automotive engine accessory drive system.

Referring now to the drawings and more particularly to FIG. 1, an exemplary automotive accessory drive belt system 10 is shown having a drive belt 12 connected to a crank shaft pulley 14 and accessory pulleys 16. An idler tensioning pulley 18 is also shown.

Figure 2:
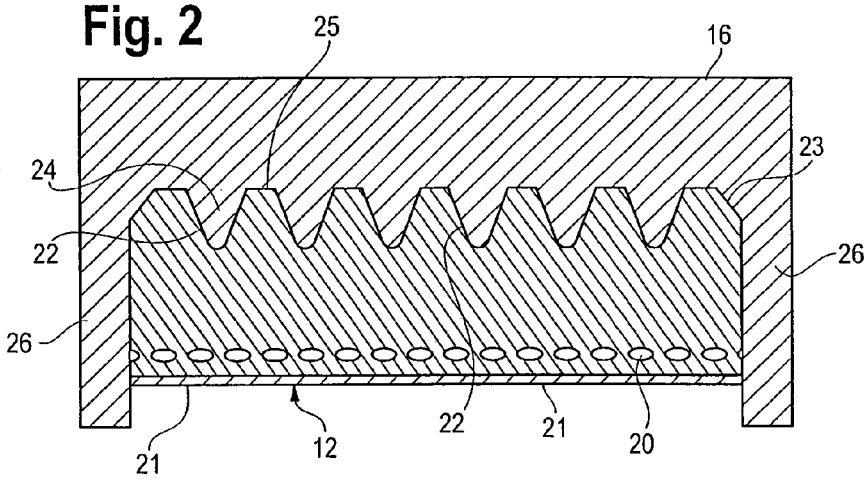
FIG. 2 is a fragmentary cross section taken at line 2-2 of FIG. 1 illustrating the relationship between a drive pulley or accessory pulley having multiple V-shaped recesses and a grooved belt.

A cross section of the belt 12 and a fragment of a pulley 16 are shown in FIG. 2. The belt 12 is customarily constructed of a pliant elastomeric material with a generally rectangular profile. The belt 12 includes reinforcing cords 20 near the driving surface or back face and a plurality of grooves 22 in the operational face. A thin impregnated fabric backing 21 protects the back face of belt 12. The grooves 22 in belt 12 are designed and adapted to receive ribs 24 formed in the annular face of the pulley 16 by intermediate recesses 25 with precision annular flanges 26 defining the working width of the pulley. The sides of the belt 12 have a bevel or chamfer 23 adjacent the operational face. The width and the thickness or depth of the belt 12 as well as the shape of the grooves 22 are controlled precisely to provide the best possible driving relationship between the belt 12 and the various pulleys 16 and drive shaft 14 of FIG. 1.

Figure 3:
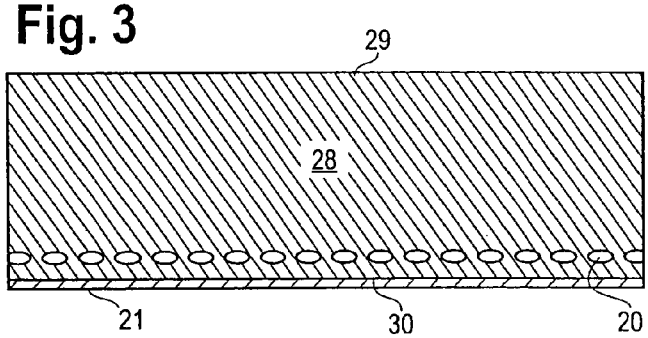
FIG. 3 illustrates a cross section of a raw belt blank before it is processed in accordance with this invention to provide the belt of FIG. 2.

The raw blank 28 for the manufacture of the multi-grooved belt 12 is a loop of elastomeric and pliant material having a generally rectangular cross section as shown in FIG. 3. The raw blank 28 has a fabric backing 21 and a pattern of reinforcement such as parallel cords 20 running longitudinally adjacent the driving surface or back face 30 of the belt and spaced from the fabric 21.

Figure 4:
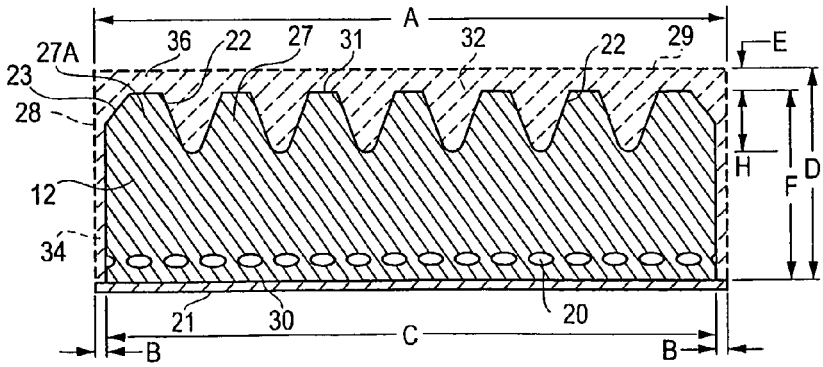
FIG. 4 diagrammatically illustrates the results of operating on the blank of FIG. 3 by the removal of material in one or more processing steps resulting in a precision multiple groove drive belt.

A diagrammatic view of the raw belt blank 28 defined by broken lines as well as the finished drive belt 12 are shown in FIG. 4. In accordance with this invention, the back face 30 of the raw belt blank 28 is the datum to which all processing is referenced. As described hereinafter, in practicing the invention there are three basic operations performed on the belt blank 28 to produce the precision multi-grooved belt 12 for current automotive applications: (1) edge material 34 indicated by arrows B and $B^1$ must be removed to provide the precision belt width C as shown in FIG. 4; (2) material 36, indicated by arrow E, is removed from the operational face of blank 28 to provide the precise thickness F of the end product; and (3) the blank material 32 of belt 12 is removed to define lands 27 between the grooves 22 in a precision operation to insure accurate, precise and intimate engagement of the pulley ribs 24 of FIG. 2 in the grooves 22. In accordance with this invention these three operations can be performed sequentially. In accordance with a preferred embodiment of the invention, all three operations can be performed with a single tool to define the vertical walls establishing width C, the operational face defined by lands 27 and dimension F and the precise configuration of the height H, girth G, angle J and radius R of grooves 22. (See FIG. 22)

In sequential processing, the overall width A of blank 28 can be reduced to width C by operation (1). As shown in FIG. 4, the overall width (dimension A) of belt 12 is reduced in manufacturing operations to dimension C by removing portions B and B'. This process is referred to as defining the vertical walls or sides of the belt. U.S. Pat. No. 5,496,208 describes a grinding wheel that is well suited for removing portions B and $B^1$ to achieve a precision overall belt width. The entire disclosure of U.S. Pat. No. 5,496,208 is incorporated herein by reference.

In a subsequent operation, operation (2) reduces the thickness D of blank 28 to the finished precise thickness F. As shown in FIG. 4, the overall thickness D of belt 12 is reduced to dimension F by removing portion 36 having a thickness E. This process is referred to as flat grinding the belt. U.S. Pat. No. 6,120,568 describes a grinding wheel that is well suited for removing portion E to achieve a precision belt thickness. The entire disclosure of U.S. Pat. No. 6,120,568 is incorporated herein by reference.

Finally, a grinding wheel incorporating the technology described herein can be used to produce the grooves of the profile. The third operation (3), in a preferred embodiment of the invention, is combined with and is performed by the same tool that performs operation (2). However, if desired, operation 3 can be performed as a sequential operation with an independent tool. As shown in FIG. 4 and magnified in FIG. 22, a groove 22 is formed in a belt 12 using the grinding wheel of the present invention. As may be observed in FIG. 22, the groove 22 has a depth or height H, a width or girth G, an angle J and an apex radius R.

An important aspect of this invention is to combine these three technologies and operations into one tool that relies upon circumferential and axial portions of the tool allocated appropriately to each of the three operations to produce the entire profile.

Figure 5:
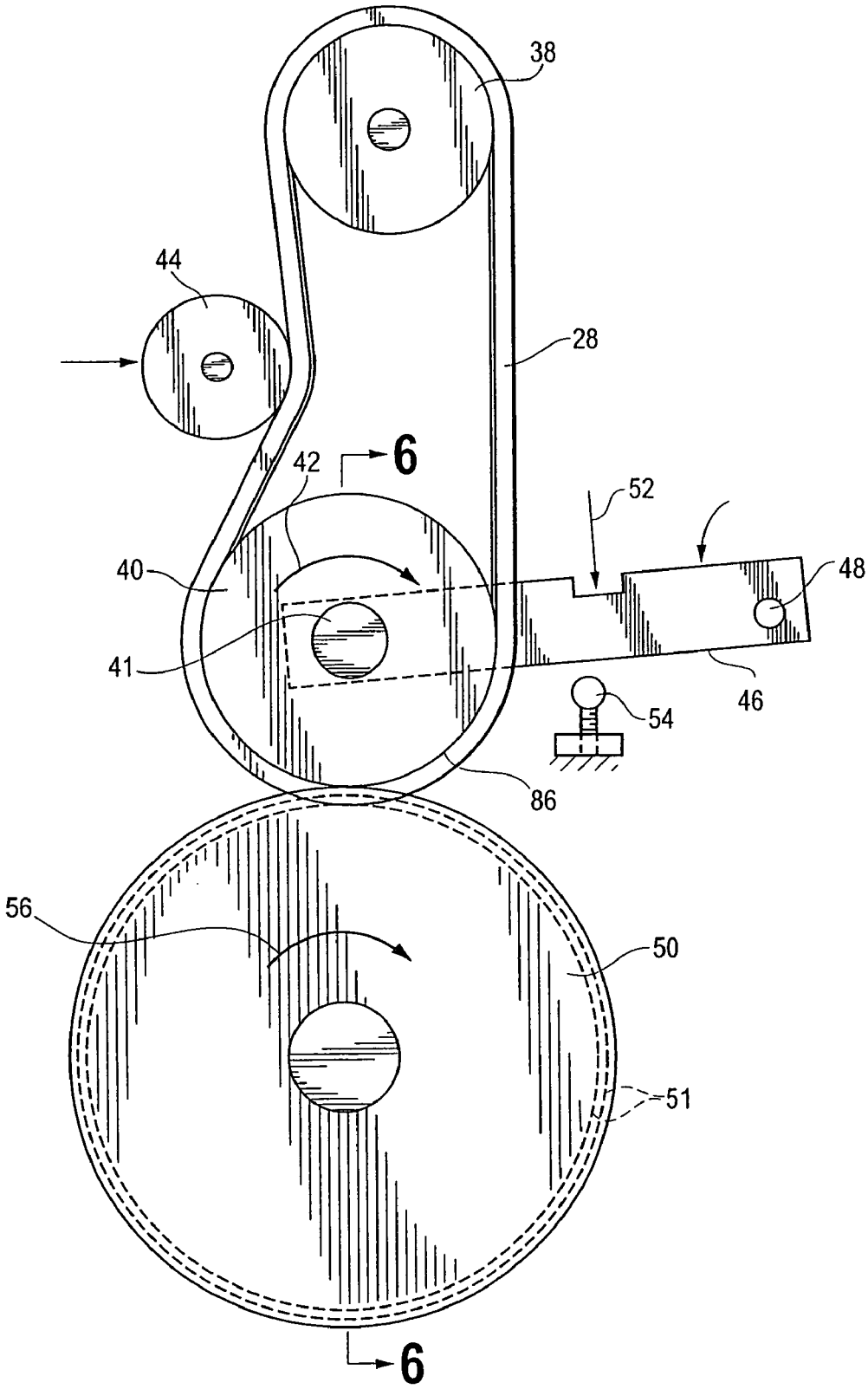
FIG. 5 schematically illustrates the grinding set up for fabrication of a finished multi-groove belt using the invention.

FIG. 5 illustrates schematically and generically how a belt blank 28 can be processed in one or more steps to produce a finished precision multi-groove automotive belt. The belt blank 28 is mounted between a drive pulley 38 and an anvil 40. The anvil 40 is driven in the direction indicated by arrow 42 by drive pulley 38 and appropriate tension is maintained in the workpiece 28 by an idler pulley 44. The drive pulley 38 and idler pulley 44 are flanged to accurately maintain the belt blank 28 against axial displacement and to align the blank 28 on anvil 40. The anvil has a smooth periphery. Anvil 40 is schematically shown mounted pivotally as by beam 46 about a pivot 48. As shown schematically, the anvil 40 is forced down against a tool 50 by a plunger illustrated by arrow 52. A stop 54 is provided to control the precision depth to which the operational face of the belt blank 28 is plunged against tool 50. As the anvil 40 presses the workpiece 28 against the tool 50, the tool 50 is driven at relatively high speed in the direction indicated by arrow 56. The tool 50 has an axially extending peripheral surface having a pattern generally indicated by broken lines 51 to form the operational face or surface in belt blank 28. FIG. 5 illustrates the general configuration of apparatus as it can be adapted and employed to perform any operation or all required operations. When the belt is finished, it is removed from the anvil 40 and drive pulley 38 and turned to have the operational face of the belt directed inwardly in the loop.

Figure 6:
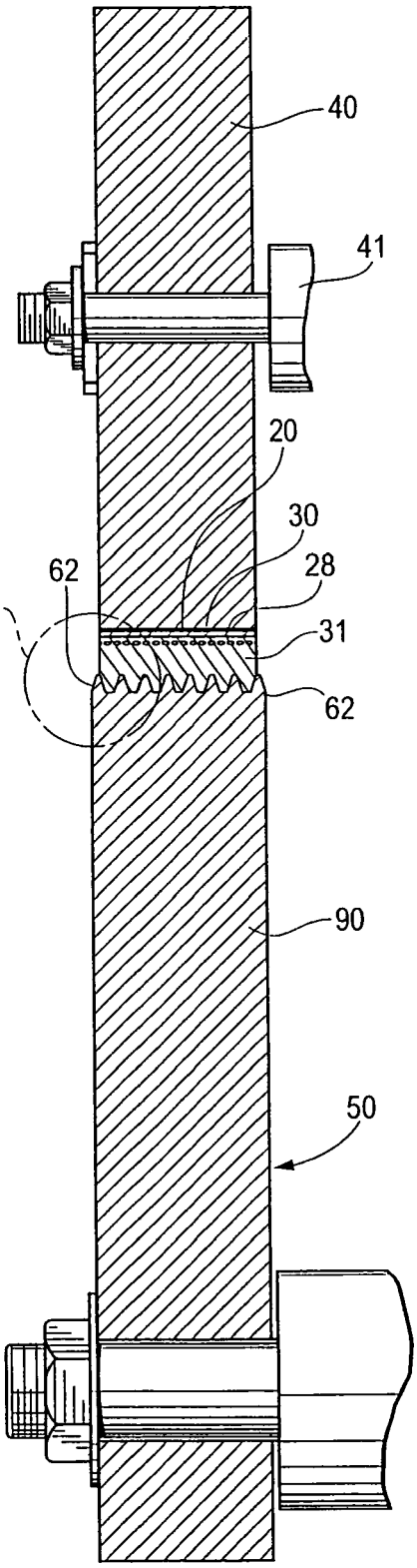
FIG. 6 is a schematic view of an anvil, belt and grinding tool taken on the line 6-6 of FIG. 5.

FIG. 6 shows a cross sectional fragment of one apparatus taken along line 6-6 of FIG. 5. For ease of illustration, FIGS. 6 and 6A conform to the combined operations (2) and (3) described in paragraph [0051]. The anvil 40 is shown mounted on spindle 41 and supporting the workpiece 28. The reinforced back face 30 in engagement with the flat anvil face and reinforcing cords 20 adjacent thereto and operational face 29 are shown schematically. In this schematic illustration the tool 50 is operating only on the operational face 29 of belt blank 28 to produce the precise thickness and grooved configuration. In the schematic illustration of FIGS. 5 and 6 the belt blank 28 had already been sized for width. In preferred embodiments of this invention precise width, thickness and groove dimensions are provided in a single operation as described hereinafter. However, many of the benefits of the invention can be obtained if a particular fabricator elects to perform the operations in two or three separate operations, similar to practices in the prior art.

Figure 6A:
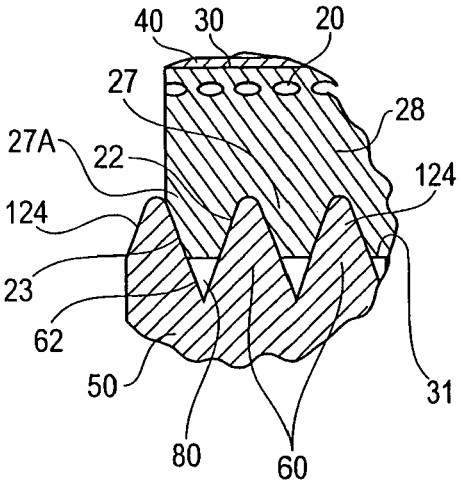
FIG. 6A shows an enlarged fragment of a tool and anvil in engagement with a workpiece in accordance with this invention.

The tool 50 is configured with six central ramps 60 and two side ramps 62 extending from base 90 axially spaced to fabricate a belt blank 28 that has been previously sized for width As shown in FIG. 6A, the tool ramps 60 and 62 are defined by tool slots 80. A pattern of abrasive elements 124 on ramps 60 define the precise configuration of six annular grooves 22 as will be described in detail hereinafter. In the workpiece 28 five central lands 27 and two edge lands 27A define the grooves 22.

Figure 7:
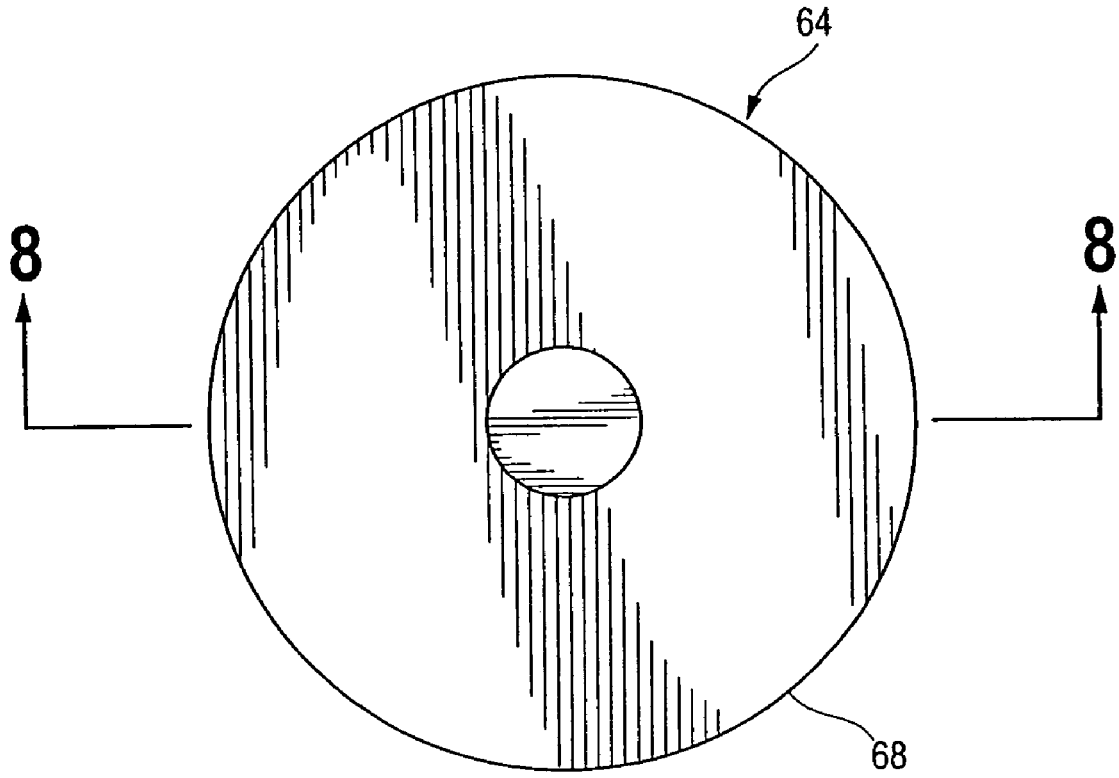
FIG. 7 is an axial view of a tool blank disk from which a rotary tool is fabricated in accordance with this invention.
Figure 8:
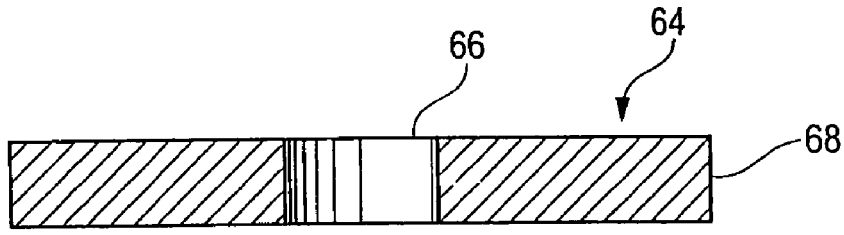
FIG. 8 is a radial view of the blank taken on the line 8-8 of FIG. 7.

FIGS. 7 and 8 schematically illustrate a tool blank 64 for the manufacture of tools in accordance with this invention. The tool blank 64 has a central aperture 66 having a diameter appropriate for mounting on the spindle of grinding apparatus and an outer axially extending cylindrical surface 68 to be processed in accordance with this invention to define a working surface.

Figure 9:
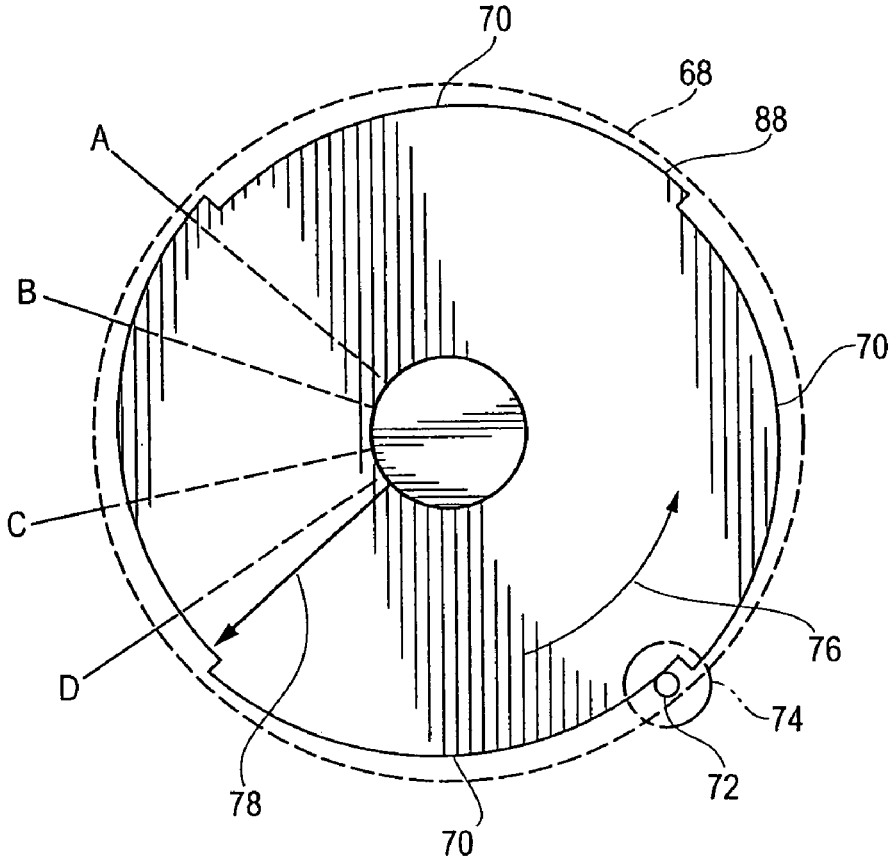
FIG. 9 shows an axial view of one tool blank after an initial processing step in accordance with this invention.
Figure 10:
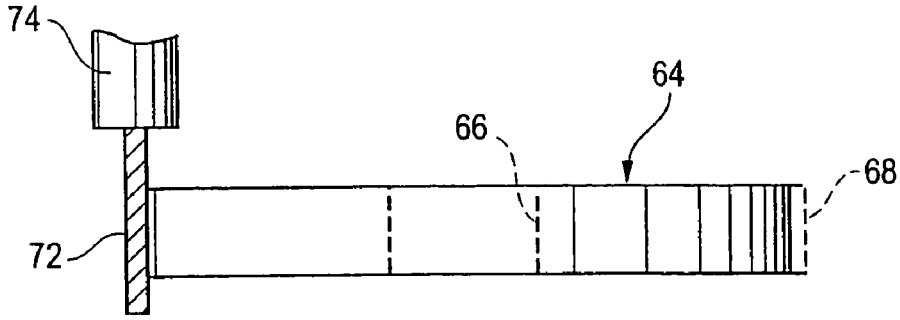
FIG. 10 is a radial view showing the tool blank of FIG. 9 and a plunge tool as it shapes the periphery of a blank disk.
Figure 24:
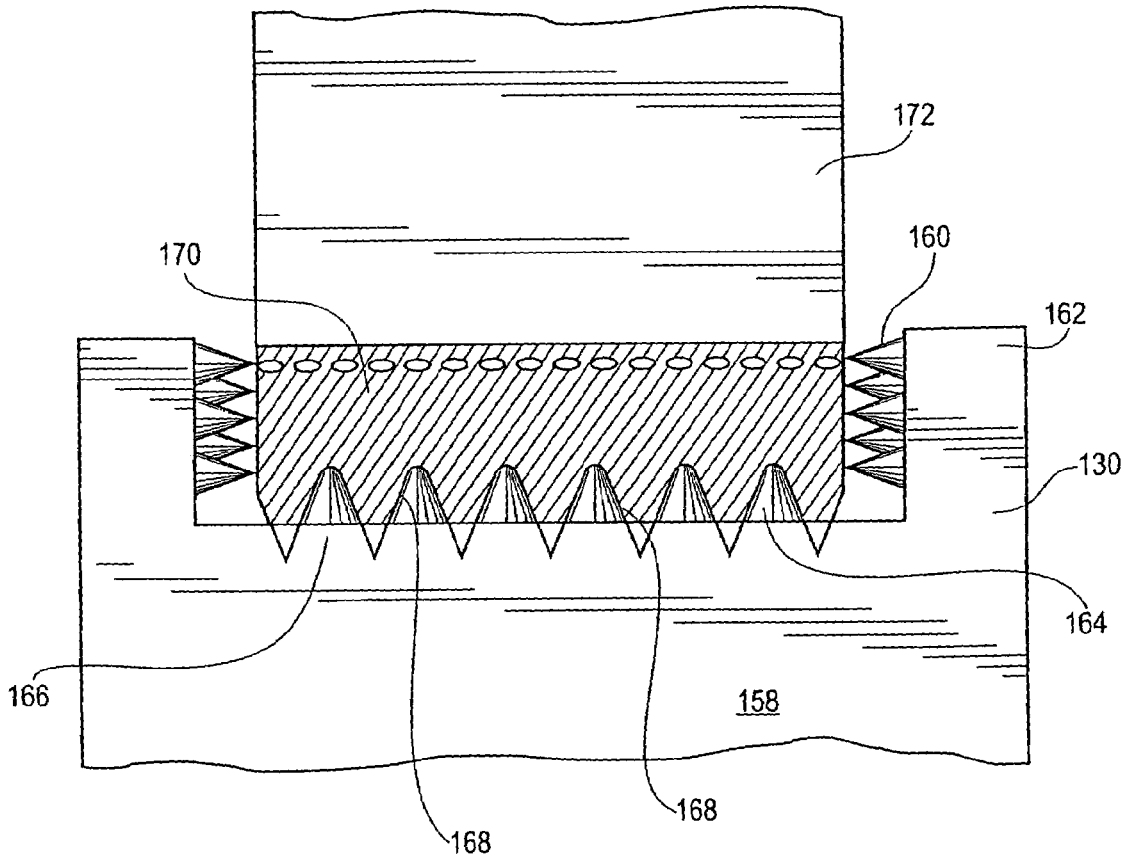
FIG. 24 illustrates a combined tool in accordance with this invention having annular flanges with precision elements for controlling belt width and the ramp and grooving elements at position A.

FIGS. 9 and 10 illustrate one of the steps in fabricating the ultimate tool from a tool blank 64 having the central mounting aperture or bore 66 and the outer surface shown by broken lines 68. For clarity, the example is for fabricating a tool to perform the operations (2) and (3) described in paragraph [0048]. A tool to perform all operations (1), (2) and (3) will include additional end flanges as shown in FIG. 24 and described hereinafter. As shown in FIG. 9, four ramps 70 are formed in the outer surface 68 in quadrature about the periphery of the tool blank 64. An end mill-type tool 72 is used in a CNC-type machine 74 shown only diagrammatically. CNC machines and end mills are well known in the art and are not described in any greater detail herein. The end mill 72 forms the outer circumferential surface with four ramps 70 in quadrature in the preferred embodiment although a single ramp or any desired number of ramps could be configured into the working surface of the tool depending upon the application and job requirements. Each ramp 70 has a profile related to the working direction of motion of the completed tool indicated by arrow 76. As shown in FIG. 9, each ramp 70 has a first segment identified generally as A where the minimum amount of material is removed from the surface of blank 68. The ramp has a constant radius in that first segment, segment 88. The end mill 72 has been controlled by the CNC equipment to gradually increase the removal of material from the original blank 68 thus progressively shortening the radius of the ramp 70 in a continuum indicated by the letters B and C. Thereafter a final segment of each ramp defines a base surface generally indicated by the letter D of constant minimum radius extending to the point where the next quadrature ramp 70 begins. At that circumferential position on blank 64 the CNC machine causes the end mill to return to the original radial position and commence the next ramp 70 with segment A. This operation is continued as many times as necessary to provide the desired ramp configuration with a minimum radius 78 defining the base surface in the segment designated D.

Figure 11:
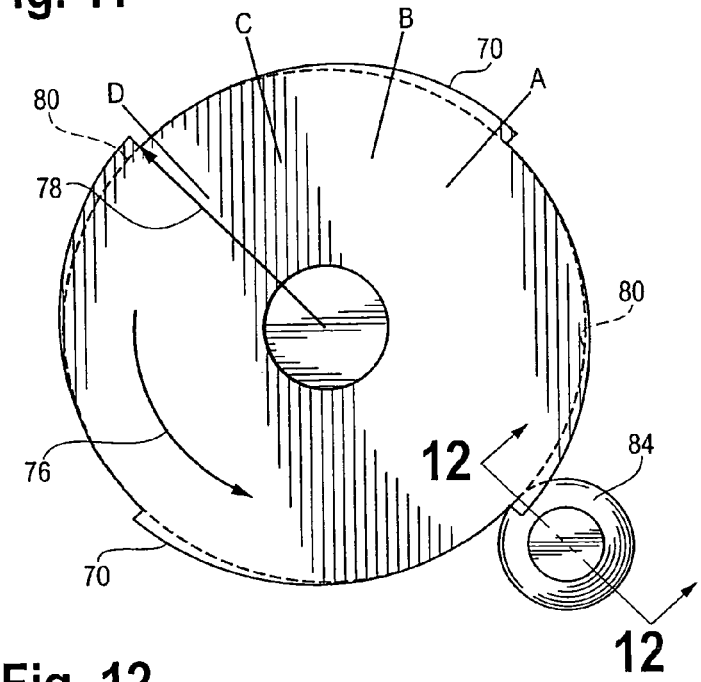
FIG. 11 shows the tool disk of FIG. 10 in a subsequent key-cutter processing step.
Figure 12:
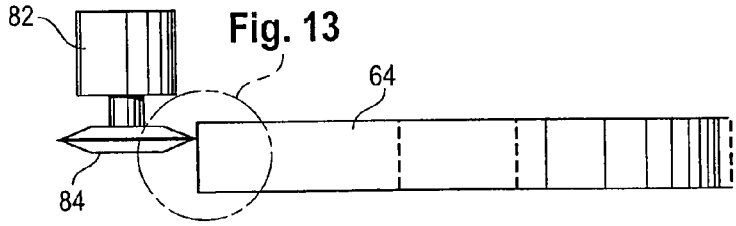
FIG. 12 schematically illustrates a key cutter for removal of steel from the annular surface of the disk taken on the line 12-12 of FIG. 11.
Figure 13:
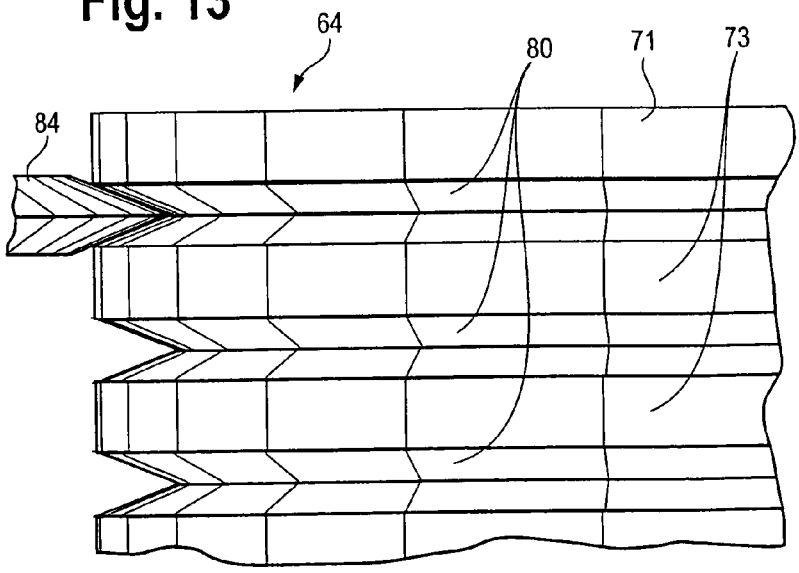
FIG. 13 shows an enlarged fragment of the tool and disk of FIG. 12.

FIGS. 11-13 illustrate another step in the process of creating the tools of this invention wherein circumferential slots 80 are formed in a tool blank 64. As shown diagrammatically in FIGS. 11 and 12, a CNC machine diagrammatically indicated at 82 is used to operate a key cutter 84 in a conventional manner to cut slots in the tool blank 64. A fragment of FIG. 12 is shown in FIG. 13 clearly illustrating the relationship of the key cutter tool 84 to the tool blank 64 and more particularly to the slots 80 formed by the key cutter 84. In the preferred embodiment the key cutter 84 cuts to the base radius corresponding to the radius along the segment D and has a cutting angle of 44 degrees. Key cutter 84 mills the blank 64 to form the slots 80 to a constant depth or base radius 78 as shown in FIG. 11. The radius 78 to which the key cutter 84 cuts the slots is equal to the radius of the segment D of the central ramps 73 and end ramps 71.

The end mill operation of FIGS. 9 and 10 and the key cutter operation described with respect to FIGS. 11-13 can be performed in the sequence as described here or the key cutting operation can be performed first. The slots 80 facilitate processing and the location of the abrasive elements described hereinafter. However, in embodiments where the ramp height equals the element height, the slots can be omitted.

Figure 14:
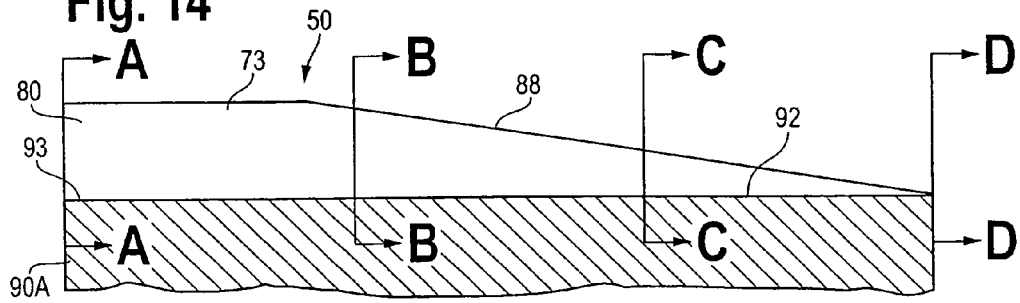
FIG. 14 is a flattened axial view of one ramp portion of the configuration of FIG. 13.
Figure 14A:
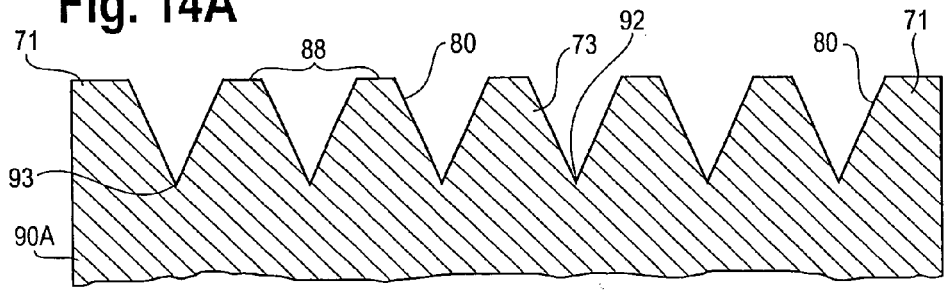
FIG. 14A-14D are sections taken at the lines A, B, C and D of FIG. 14 showing the ramps and slotting of one quadrant of the wheel of FIG. 13.
Figure 14B:
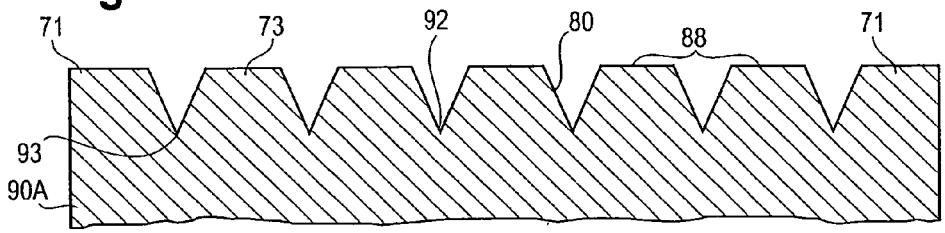
Figure 14C:
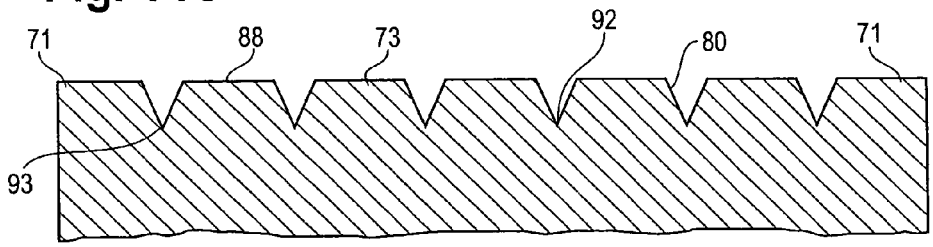
Figure 14D:
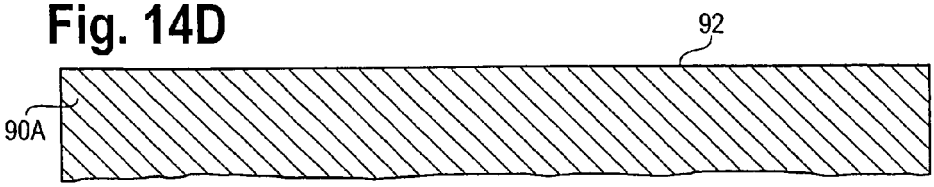

FIG. 14 illustrates a fragment of a tool 50 according to one embodiment of the invention. With tool 50 the steps (2) and (3) described in paragraph [0048] are performed in a single operation. In FIG. 14 one of the arcuate central ramps 73 and a fragment 90A of the tool base 90 from which the ramp 73 extends are shown in a linear projected schematic view in order to better illustrate the nature of the ramps 71 and 73 and the slot walls 80 that define those ramps. FIGS. 14A-D are cross sections taken in FIG. 14 at lines A-A, B-B, C-C, and D-D. As shown in FIG. 14A each slot 80 extends to an apex 93 level with base surface circumference 92 and have a maximum depth when the ramps 71 and 73 are at their maximum height in segment 88 at A-A. Thus, in the operation of the tool embodiment of FIG. 14 on a workpiece 28 as illustrated schematically in FIG. 5, the first portion of the tool 50 to engage the workpiece 28 will be the base surface 92 and more particularly abrasive elements on that surface of segment 88 at section D-D of the completed tool, to be described.

The tool 50 rotates with high linear peripheral speed compared to the linear speed of the workpiece as it passes the tool and relative to the radial speed of the workpiece toward the tool. Thus the abrasive elements on the ramps 73 will cut very rapidly as the ramp approaches the workpiece. In one embodiment, a 10½ inch tool according to FIGS. 14-17 in the position of schematic tool 50 of FIG. 5 rotates at about 3600 rpm. This provides a linear speed at the contact point of about 9800 ft/minute. In contrast, the workpiece at that contact point has a linear speed of about 40 ft/min.

Figure 15:
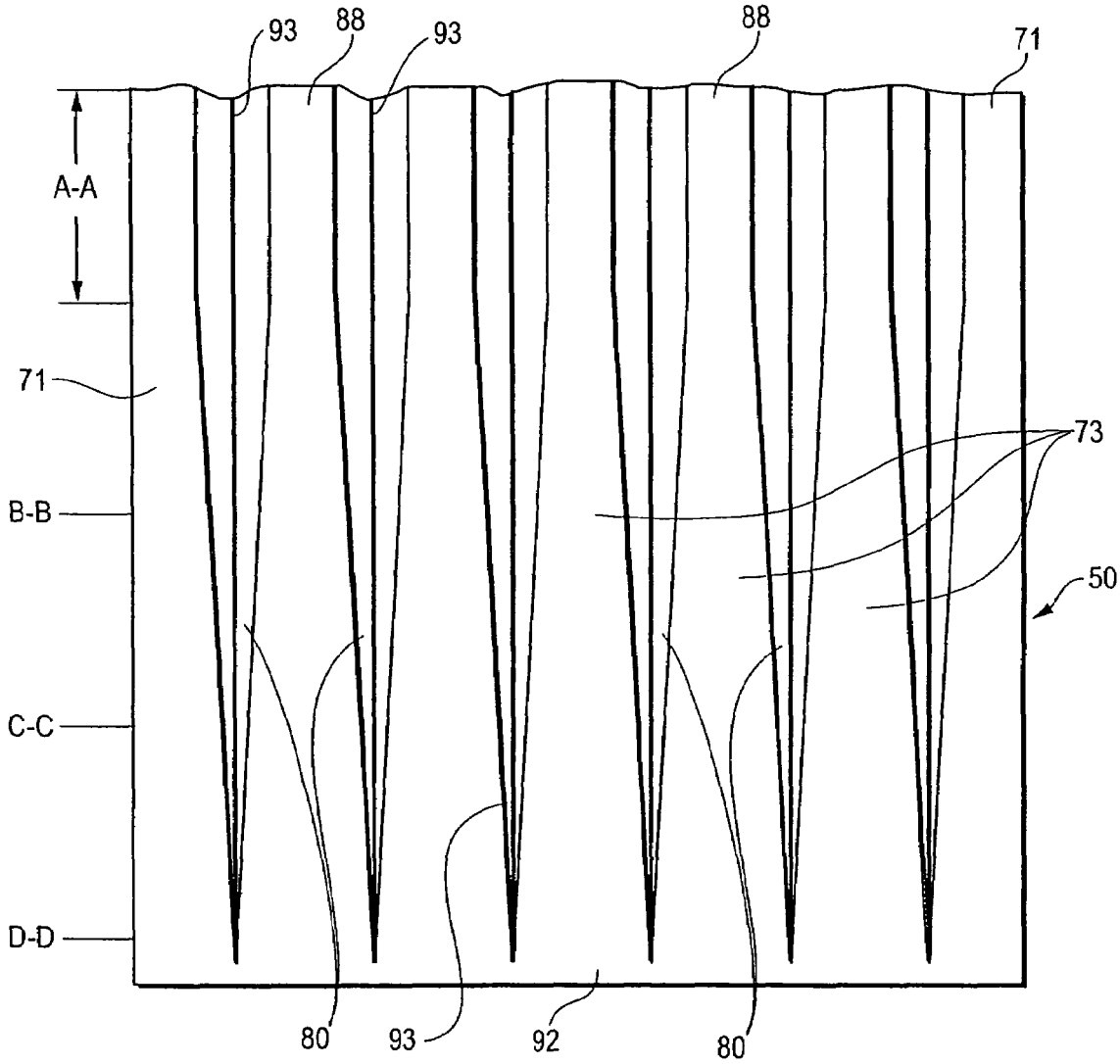
FIG. 15 represents a top view of the flattened view of FIG. 14 showing the configuration of the six slots between circumferential positions A and D.

A top view of the linear projection of the ramp in FIG. 14 is shown in FIG. 15. Each slot 80 formed by the key cutter as described in FIGS. 11-13 extends over the full quadrature portion of the end ramps 71 and central ramps 73 from the high segment 88 of the ramp at A-A in FIGS. 14 and 15 to the base surface 92 at D-D. The apices 93 of slots 80 have a constant radius to the point where they become a part of the base surface 92 that has the same radius at line D-D. The base surface 92 of the tool extends beyond D-D up to the beginning of the next ramps in the section A-A of the next subsequent tool quadrant.

Figure 16:
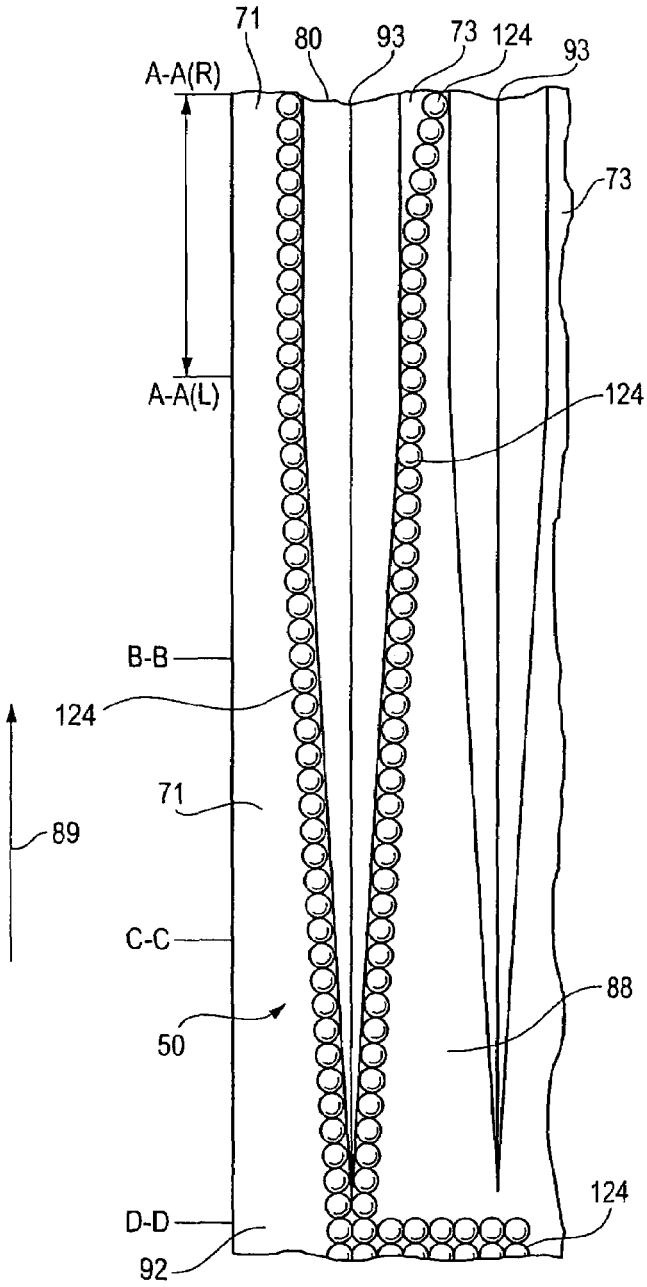
FIG. 16 is another flattened fragmentary top view of a portion of the ramps of FIGS. 14 and 15 showing the application of abrasive elements to the left side of one ramp and to the base.
Figure 17:
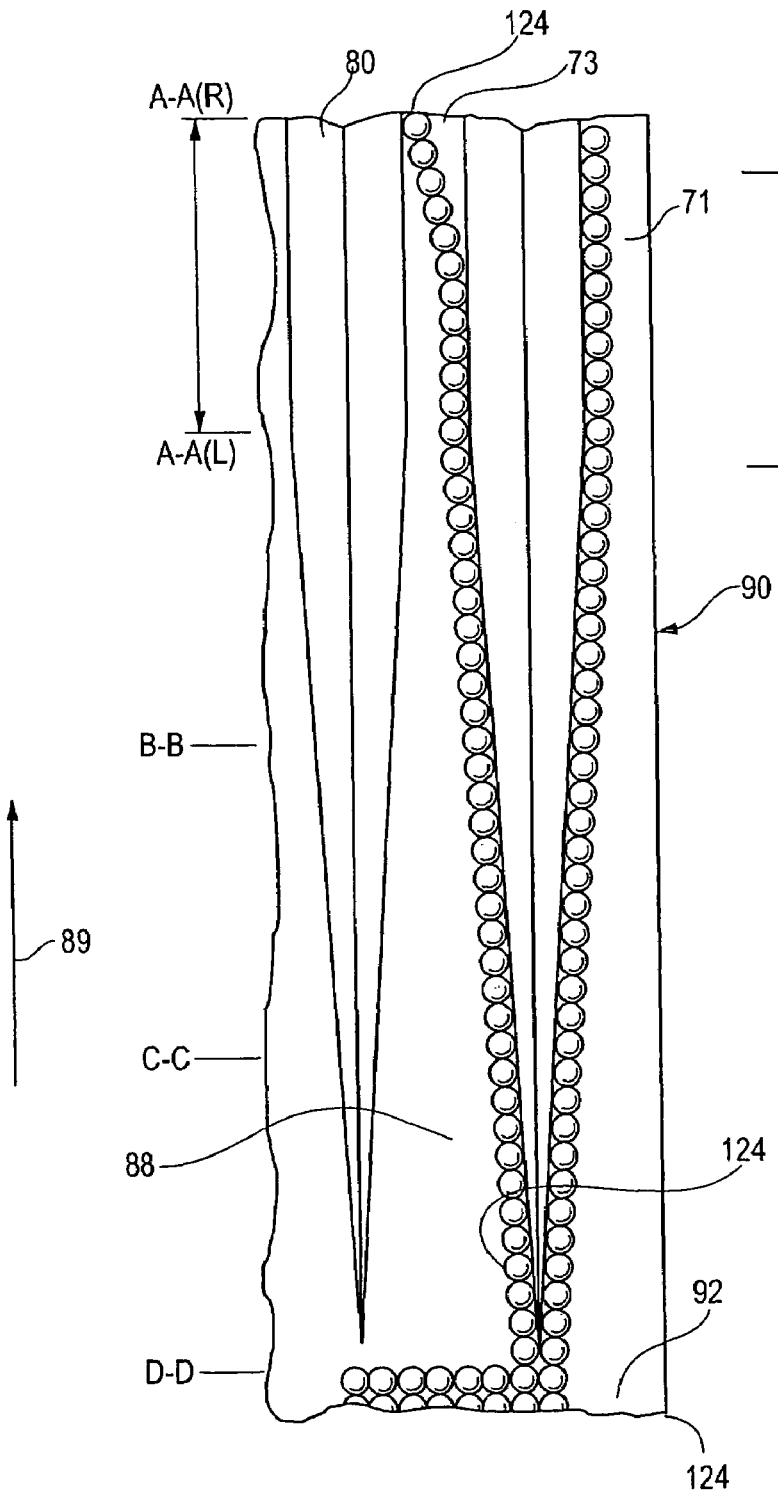
FIG. 17 is another flattened top view of a portion of the ramps of FIGS. 14 and 15.
Figure 17A:
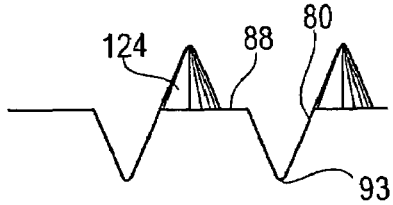
FIGS. 17A(L) through FIG. 17D show elevation views taken at the lines A-A through D-D of FIG. 17 at circumferential positions A-D.
Figure 17A:
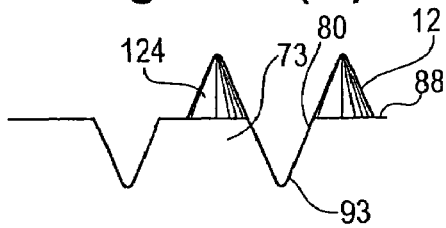
Figure 17B:
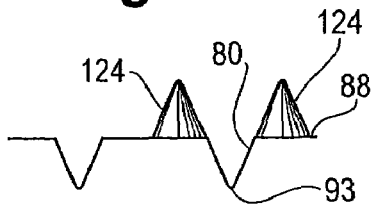
Figure 17C:
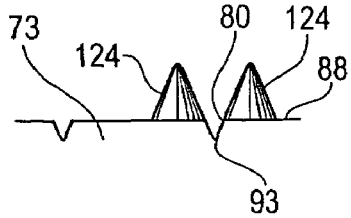
Figure 17D:
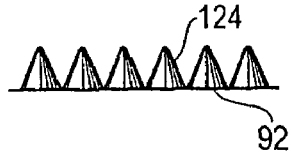

In further processing of a tool 90 in accordance with this invention for use in the schematic of FIG. 5, abrasive elements in the nature of small cones made up of many smaller cobalt coated tungsten carbide particles are connected by brazing to the continuum of ramp surfaces 88 of ramps 73 from A-A to D-D and to the base surface 92 beyond D-D. FIGS. 16 and 17 illustrate the pattern of elements for a tool such as tool 50 of FIGS. 6, 14 and 15.

The cone-like abrasive elements 124 are fused to the circumferential surfaces 88 of ramps 71 and 73 and the base surface 92 at D-D. In a subsequent step, to be described, the elements 124 are dressed to provide precision grinding surfaces.

The cone-like elements 124 are initially produced as a matrix interconnected by and oriented on a flexible carrier as schematically shown in FIGS. 25-28A and as set forth in greater detail in U.S. Pat. No. 5,181,939 which is incorporated herein, in its entirety, by reference. The matrix is then broken down into individual elements, or strips or blocks of elements that are secured to the machined tool blank and fired and fused to the tool.

Figure 25:
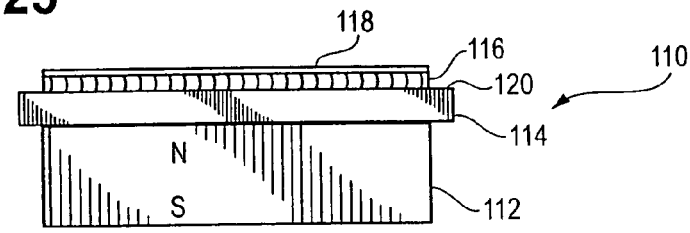

Specifically referring to FIG. 25, a single layer of protrusions in the form of steel balls 116 are affixed by adhesive 120 to plate 114. The balls 120 are preferably then fused to plate 114 that is secured to a large magnetized base 112 of fixture 110. A release mechanism 118 is shown as a thin layer of nonferrous material such as a sheet or film of plastic, preferably Teflon. The release mechanism is placed over the upper surface of the balls 116. A source of vacuum may be introduced to the region between the protrusions and the release mechanism 118 by providing suitable passageways and seals (not shown). The vacuum will draw the release mechanism 118 into firm contact with the protrusions 116. This completes the fixture upon which a matrix of braze paste and magnetically oriented abrasive particles may be prepared.

Figure 26:
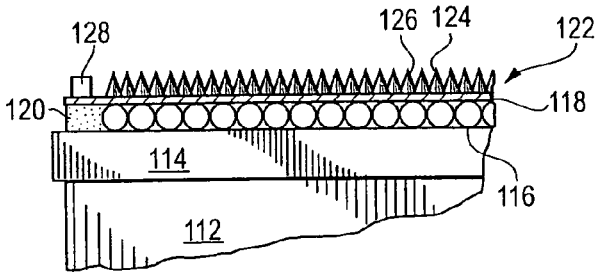

The matrix 122, as shown in FIG. 26 is prepared by sprinkling or diffusing 200/325 mesh tungsten carbide cobalt coated particles (not shown individually in this figure) onto the release mechanism 118. The particles are attracted to balls 116 by the magnetic flux from magnet 112. These particles will collect on the release mechanism 118 at the locations of magnetic field concentration formed by the individual steel balls 116.

Therefore, the size, shape, location and arrangement of the balls 116 determines the pattern generated by the carbide particle collections. Larger diameter balls will provide magnetic field concentrations which are spread farther apart. Thus, larger diameter balls may be used to produce a coarse textured surface. Specific sizes, shapes and arrangements of balls may be used to generate any desired pattern.

As the carbide particles are diffused onto the release mechanism 118, they will form collections as triangular cross sectioned elements 124. In the preferred embodiment of the present invention, the structures 124 will be conically shaped, hereinafter referred to as cones or, more broadly, elements. When the cones have reached a desired height by addition of particles they are sprayed with an acrylic paint or a mixture of 1.5% polyvinyl butyl and lacquer thinner.

After the paint has dried or solidified, the cones are coated with a water based braze cement (not shown) which provides a protective layer isolating the acrylic paint which maintains the structural integrity of the cones from the solvent contained in the coating of braze paste 126 which is added after the braze cement. A water based cement consisting of one part Nicrobraze Cement Type S, a trademark of Wall Colmonoy Corporation, and two parts water is preferred.

Braze paste 126 is then added to encapsulate the cones. A braze paste consisting of a binder or cement, preferably 40 percent Nicrobraze Cement 1020, a trademark of Wall Colmonoy Corporation, and a braze alloy, preferably 60 percent −325 mesh low melting point brazing filler metal. Any braze cement which dries or cures to a flexible structure will be satisfactory. Form 128 placed on the release mechanism 118 serves as the outer boundary to which the braze paste 126 may flow. The height of form 128 will define the thickness of the matrix.

Figure 27:
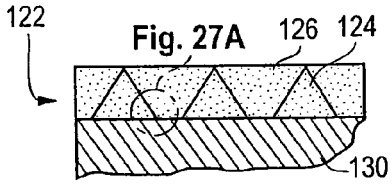

The braze past 126 cures or dries to provide a flexible matrix 122, a fragment of which is shown in FIG. 27. This matrix 122 and release mechanism 118 may then be removed from the fixture 110 as a viable structural entity. The matrix may be cut to any desired pattern. The release means 118 may then be removed from the matrix 122 by peeling it away. After the release mechanism 118 has been removed, the matrix 122 may be secured to a second base structure 130, as shown in FIG. 27, by use of pressure sensitive adhesive preferably ROBOND 2000. Any suitable adhesive or binder may be utilized.

Figure 27A:
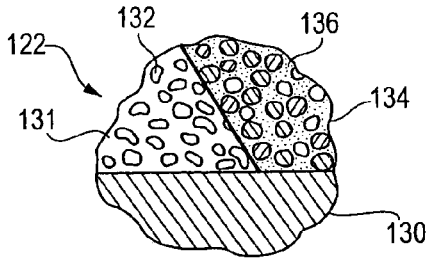
FIG. 27A is an enlarged fragment of the encircled area in FIG. 27.

FIG. 27A is an enlarged section of FIG. 27 illustrating the matrix 122 consisting of tungsten carbide cobalt particles 132, acrylic paint 131 and the braze paste 126, which itself consists of braze metal 134 and cement 136. After the matrix has been secured to the surface of the base structure 130, the entire assembly may be placed in a braze furnace and heated to brazing conditions, that is, the necessary brazing temperature for the necessary time period. Any temperature between 1850° F. and 2150° F. for a time period of approximately 15 minutes is appropriate for a low melting point brazing filler metal. An atmosphere of pure dry hydrogen or a vacuum is recommended. A hold cycle of 30 minutes is recommended at 800° F. before elevating to braze temperature. The braze metal 134 will become molten and flow to form a mortar-like bond of metal 138 (as shown in FIG. 28A) which secures or joins the tungsten carbide cobalt particles 132 together individually and to the base structure 130. Thus, after brazing, only the braze alloy and abrasive particles remain as the binder has vaporized.

Figure 28:
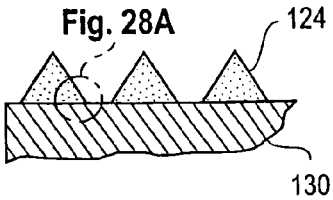
Figure 28A:
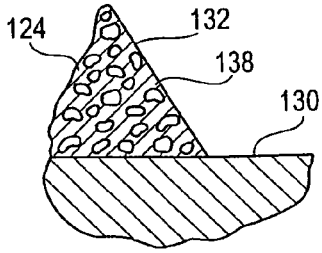

The final product, as shown in FIGS. 28 and 28A, is a base structure 130 that is armed with cones 124 of particles 132 and braze metal 138 that provide the abrading tool cutting points.

Figure 23:
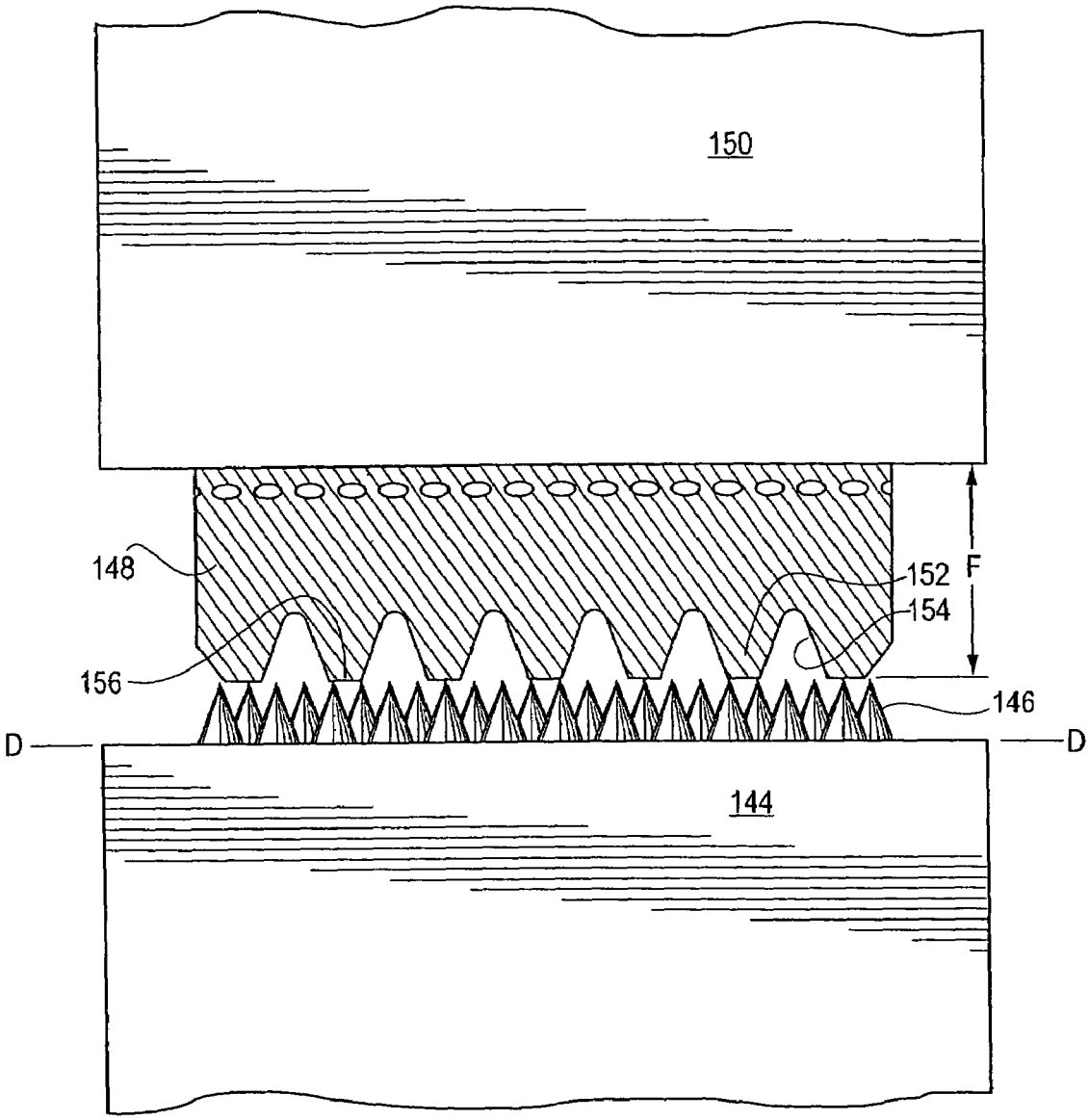
FIG. 23 shows an anvil and spaced tool with dressed elements for precision control of the thickness of the finished belt.

Fragments of FIG. 15 are shown in FIGS. 16 and 17 with representative elements 124. FIG. 16 shows a lefthand tool fragment showing an end ramp 71 and one central ramp 73. Abrasive elements 124 are laid in relatively straight paths on the portion of the constant radius ramp surfaces extending from line A-A(R) to A-A(L). The line of elements 124 extends from the right edge of the surface 88 of central ramp 73 diagonally to the left edge. From the line A-A(L) to line D-D in FIG. 16, the abrasive elements 124 follow the left edge of the ramp surface 88 as the ramp surface radius diminishes in a continuum to line D-D. At line D-D, the ramp surface 88 blends into constant radius cylindrical base surface 92. Surface 92 has a pattern of elements 124 that determines the workpiece thickness as shown in FIG. 23. Thus the righthand side of tool slot 93 is defined. A similar set of elements 124 on the ramp 73 in the next quadrature sector defines the lefthand side of slot 93 and the beveled edge of the first workpiece land (27A in FIG. 6A).

In one embodiment of the invention, the ramp surface 88 in the segment A-A is 0.075 inch wide and the ramp is 0.085 inch above the radius of base 92. The total axial pitch from ramp to ramp is 0.140 inch. That is, the axial spacing from one slot apex 93 to an adjacent slot apex 93 is 0.140 inch. The cone-like elements 124 are 0.085 inch high and 0.060 inch in diameter at their base.

The orientation of the rows of elements 124 shown in the FIGS. 16 and 17 fragments of FIG. 15 illustrates a feature of the invention. The tool 90 as shown flattened in FIG. 15 is constructed with five central ramps 73 defined by six slots 80 and with axially spaced side or end ramps 71. As will be seen in FIG. 16, the left slot 80 not only defines the edge of the ramp 73 on the right side of slot 80 but it also defines a side or end ramp 71. This defines a central workpiece land 27 and an end land 27A (see FIG. 4). The side ramp 71 in FIG. 16 has a set of aligned abrasive elements 124 disposed to define the chamfer bevel 23 of FIG. 4. Arrow 89 shows the conventional direction of motion relative to the workpiece.

FIG. 17 illustrates the right portion of FIG. 15 as it would appear in the quadrature sector adjacent to that shown in FIG. 16. There the aligned elements 124 start at the right side of the ramp 73 and lie along the right side from the line D-D to the line A-A(R). From the line A-A(R) to A-A(L) the ramp is of a constant width and radius and the elements 124 follow a generally straight line from the right side of the ramp 73 to the left side of that ramp.

Figure 16A:
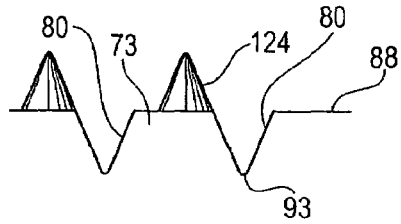
FIGS. 16A(R) through FIG. 16D show elevation views of the ramp and elements of FIG. 16 at circumferential positions A to D.
Figure 16A:
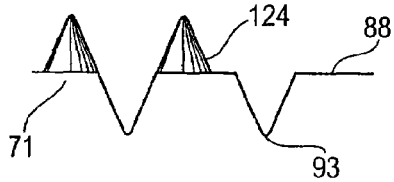
Figure 16B:
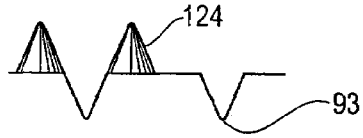
Figure 16C:
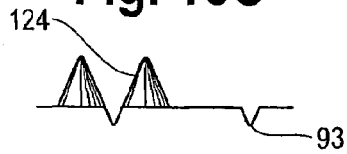
Figure 16D:
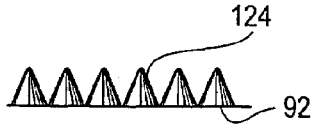

FIGS. 16A(R) through 16D and 17A(L) through 17D are sectional views taken on the linear projection of the tool circumferential surface shown in FIGS. 16 and 17 and illustrate the manner in which the abrasive particle elements 124 are positioned axially with respect to the slots 80 and ramps 73 at selected circumferential locations.

Between the ramps 71 and 73 on the left side of the tool 90 as shown in FIG. 16 and the ramps 73 and 71 on the right side of the tool 90 as shown in FIG. 17, there are three additional central ramps 73 as shown in FIG. 15. The intermediate central ramps in the tool 90 of FIGS. 14-17 can have the element patterns as shown in FIG. 16 or 17, respectively intermixed. A tool, such as one for fabricating the workpiece of FIG. 4 having six grooves, will have six ramps. In the configurations having an even number of ramps, the left to right and right to left element patterns are alternated. An important advantage of the use of the two distinct element patterns is believed to be a distribution of the axial or side-wise forces on the pliant workpiece, minimizing distortion and resulting in enhanced product precision.

Figure 18:
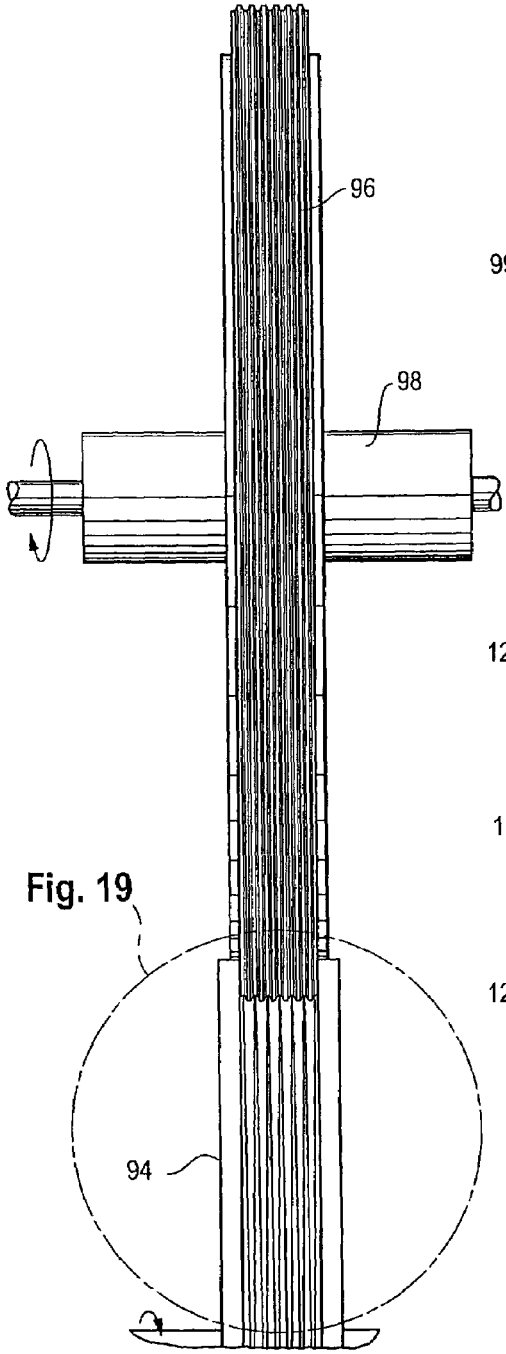
FIG. 18 shows the tool of FIGS. 16 and 17 in position relative to a dressing tool.
Figure 19:
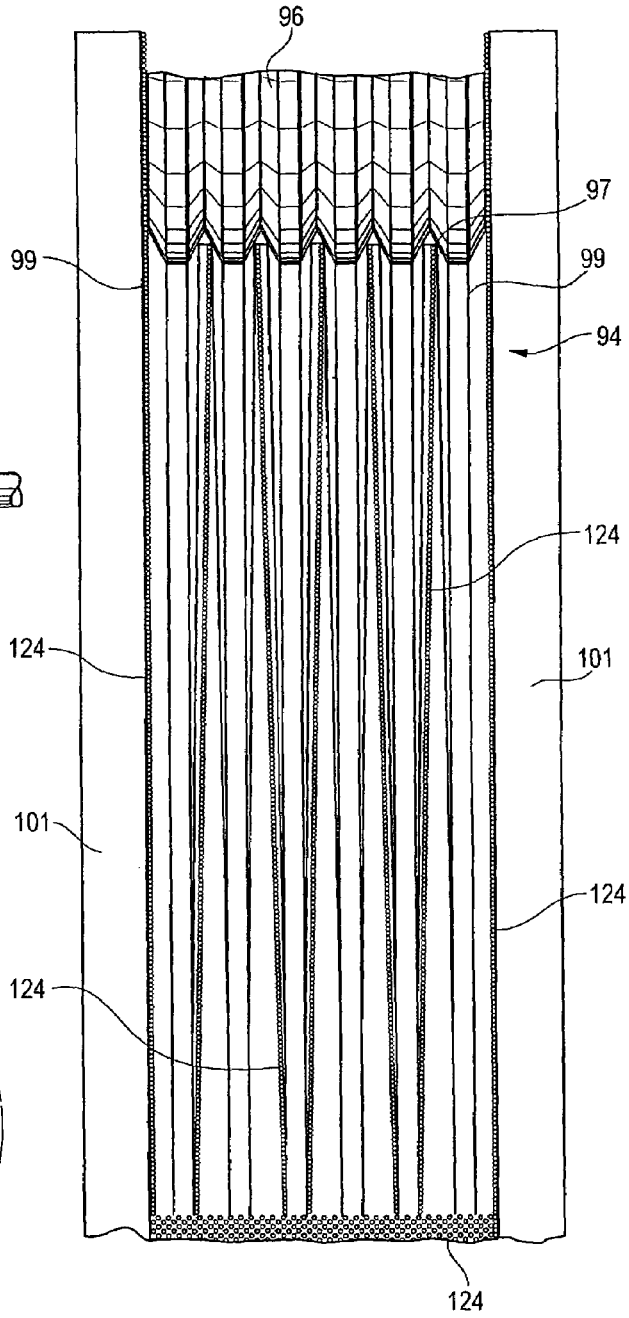
FIG. 19 is an enlarged view of the encircled portion as labeled in FIG. 18.

FIGS. 18 and 19 schematically show that a tool 94 according to this invention has a vast number of abrasive elements 124 as a result of the steps described and illustrated in FIGS. 14-17. Although illustrated as perfect specimens, each of those elements has dimensional manufacturing tolerances which would preclude the precision manufacture that is sought. In the next step shown in FIGS. 18 and 19, the tool 94 and elements 124 are finished by a dressing wheel 96 having a working surface coated with diamond particles and mounted for rotation on a drive shaft 98. The interface of the dressing tool 96 with a tool 94 is shown in FIG. 19. The tool can be designed to make a workpiece having any desired number of grooves from 1 through 6 or 7 or more and consequently any number of lands for driving engagement with a corresponding number of recesses in the various pulleys of an automotive accessory drive system. In the dressing system illustrated in FIG. 19, the tool 94 has five central ramps 97 plus two end flanges 101 with beveled ramps 99. The five central ramps with abrasive elements 124 disposed thereon will define five grooves and four central lands in the ultimate pliant workpiece. The beveled end ramps 99 with abrasive elements 124 thereon will provide a chamfer on the end lands of the workpiece as already described.

Figure 20:
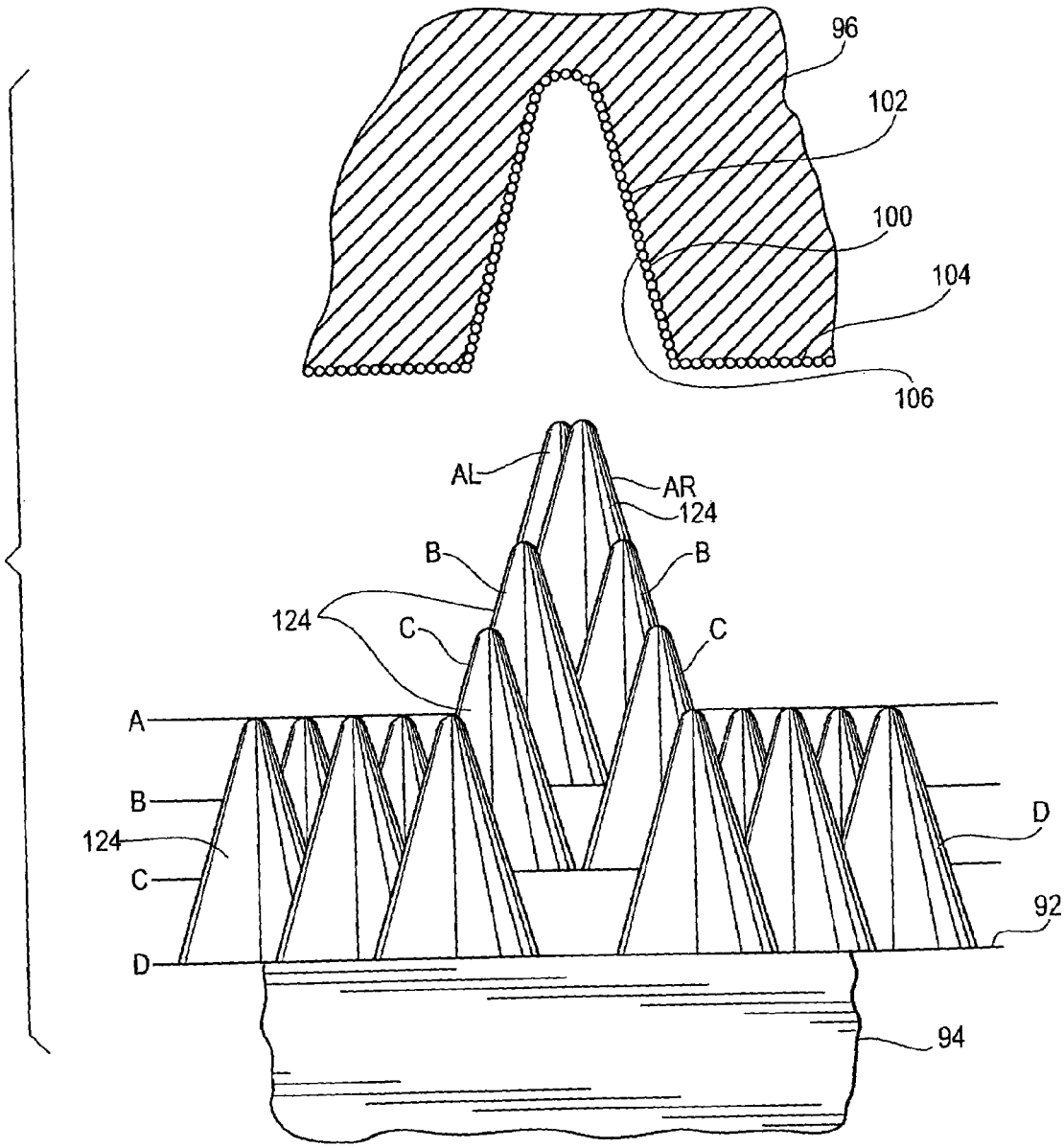
FIG. 20 is a schematic view of a fragment of the dressing tool juxtaposed above views of four cross sections of the ramp and elements at positions A through D shown in FIG. 11 et seq. and superposed.
Figure 21:
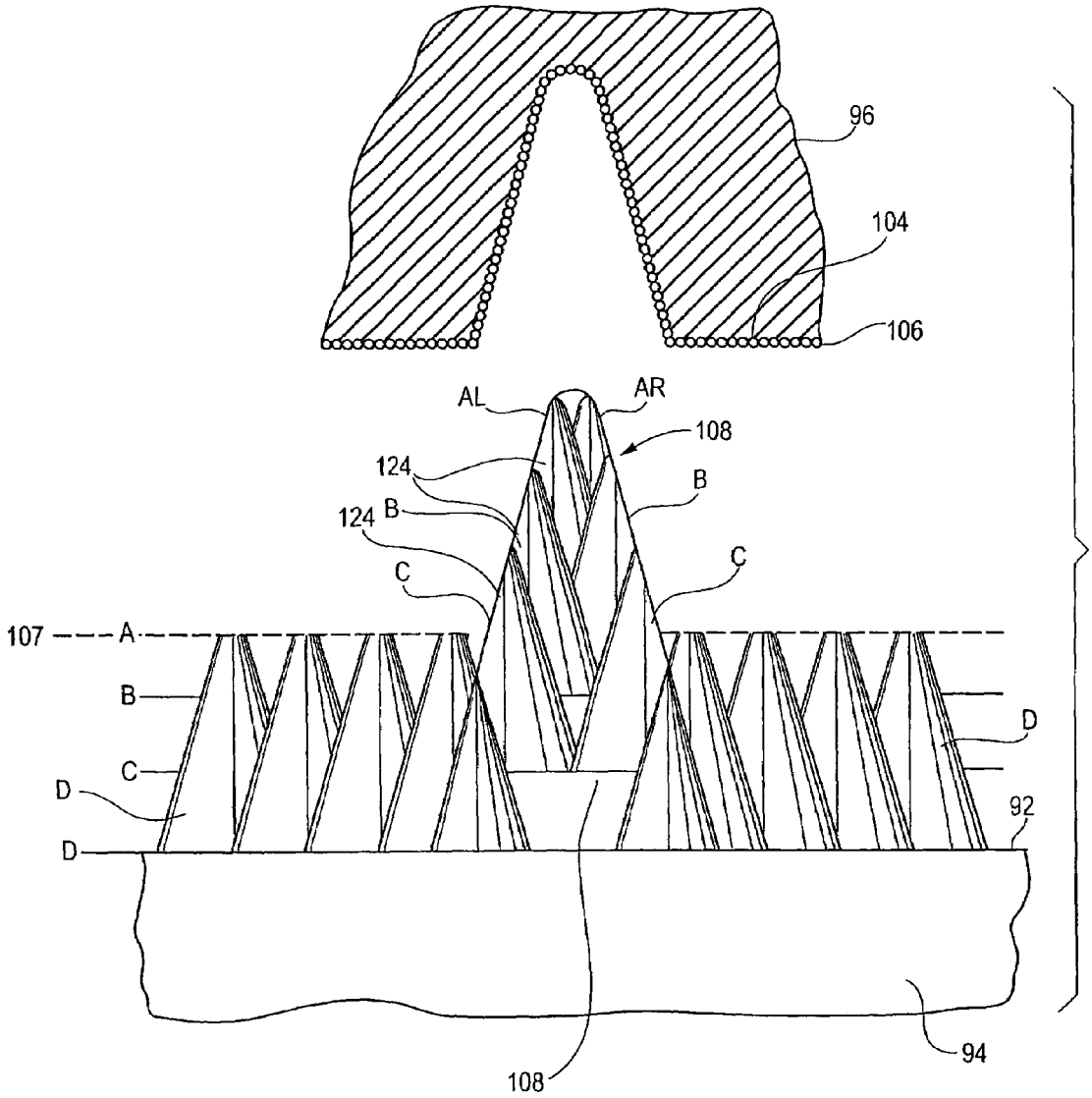
FIG. 21 is a view similar to FIG. 20 but showing the configuration of the superposed views of four cross sections at A-D after the dressing operation is completed whereupon the tool can be assembled in the configuration shown in FIG. 5 for finishing a belt having multiple grooves.

To shape the elements to conform to the precision shape desired in the ultimate workpiece, the dressing wheel 96 is shaped to the precision pattern of the ultimate workpiece with a recess corresponding to each ramp of the tool. The dressing wheel is coated with very fine diamond particles 102 not visible in FIGS. 18 and 19. In FIG. 20, a fragmentary schematic of the dressing wheel 96 is shown with one recess 100 coated with diamond particles 102 for dressing the abrasive elements on the tool ramps. The working surface of one ramp is exemplified by abrasive elements AL, AR, B and C. The dressing tool 96 has a circumferential periphery 104 coated with fine diamond particles 106 to dress the elements D on the base surface 92, a fragment of which is shown in FIG. 20. FIG. 20 is a developed illustration in a single plane of the position of the abrasive particle elements as shown in FIGS. 16 and 17. The elements AL and AR are on the ramps in segment A of FIGS. 14-17, while elements B are at circumferential position B, elements C are at circumferential position C and elements D are on the base D, respectively. As shown in FIG. 20, the conic abrasive elements have not been dressed with the diamond wheel 96, and would have an uneven and imprecise configuration. The end result after dressing is illustrated in FIG. 21 where the fragment of the dressing wheel 96 is shown positioned above the dressed base surface 92 and ramp 108. Exemplary dressed abrasive particle elements AL, AR, B, C and D illustrate the manner in which the elements of FIG. 20 have been dressed to define a single precise outline of the desired groove in the workpiece when the tool 94 is rotated in processing a belt blank. FIG. 21 also illustrates the manner in which the elements on the base surface 92 are dressed to provide the base grinding surface 107 and the precision workpiece thickness F in FIG. 4. Rapid rotation of the tool with relatively slow movement of the workpieces presents a continuum of the patterns described with respect to FIGS. 14-17. Other abrasive materials such as large diamond, tungsten or carbide pieces formed as elements or elements assembled from fine diamond particles or dust can also be employed to obtain the benefits of the invention.

Figure 22:
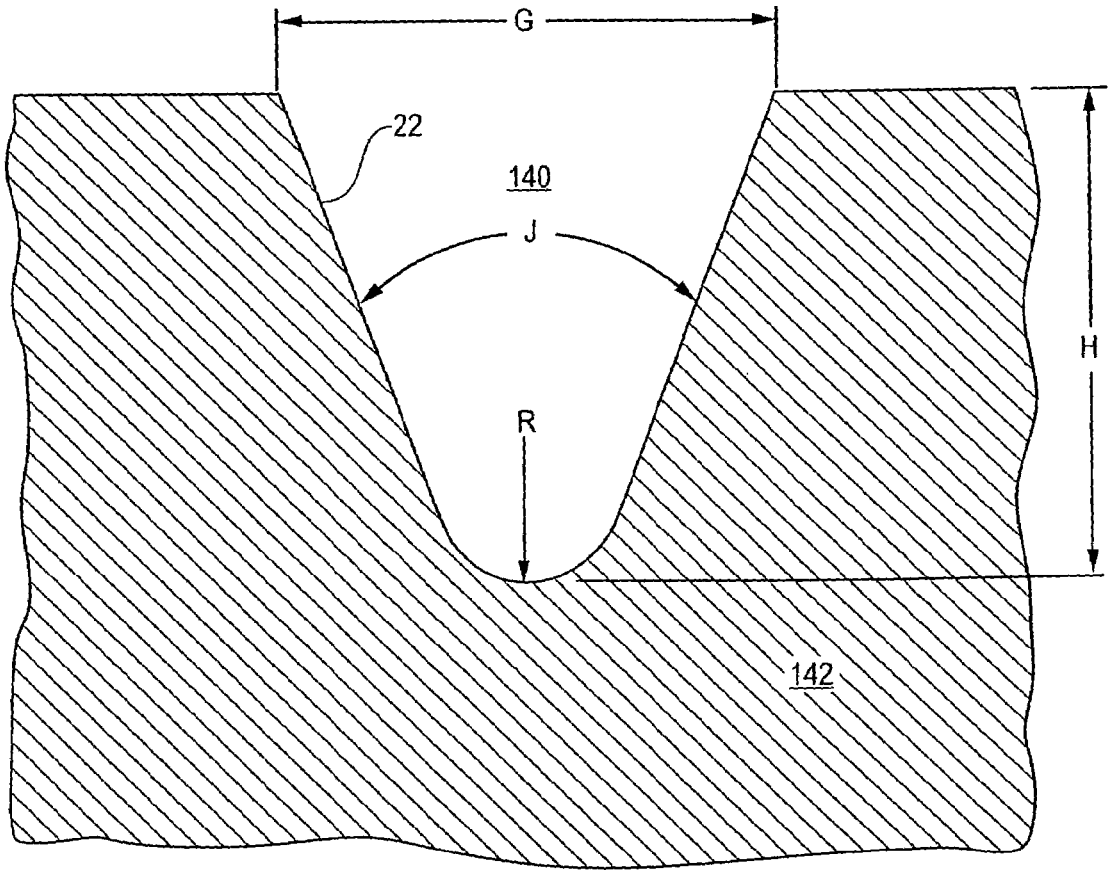
FIG. 22 shows one such finished belt groove.

FIG. 22 illustrates the precise groove 140 formed in a fragment of the pliant workpiece 142. In the described embodiment the workpiece grooves have a girth or width of 0.082 corresponding to the girth G shown in FIG. 4 and described heretofore. The groove 140 has an included angle J of 44 degrees and a radius R in the apex of 0.010 inch. The height H of the groove at the working face of the pliant material 142 in this particular embodiment is 0.08 inch.

FIG. 23 illustrates the manner in which the thickness F shown and described with respect to FIG. 4 is established in the operation when using the apparatus of FIG. 5 with a tool 144 having a pattern of abrasive elements 146 in accordance with FIGS. 16 and 17. The workpiece such as belt 148 is supported on the anvil 150. The workpiece has been previously processed to have the required width and has been axially positioned on the anvil 150 by the other flanged pulleys all corresponding to the schematic equipment described with respect to FIGS. 5 and 6. The abrasive elements 146 of FIG. 23 correspond to the abrasive elements at location D of FIGS. 9-11 illustrating preferred embodiments of this invention that control with precision the thickness of the workpiece. The precision shaping and finishing of the lands 152 and grooves 154 at circumferentially spaced locations A, B and C are provided by the ramps that are circumferentially spaced from location D, as shown in FIGS. 16 and 17. The embodiment described here is a preferred embodiment that will perform both the sizing for thickness and the formation of precision grooves in a single operation. These two operations can be performed separately if desired. A separate tool, as described in U.S. Pat. No. 6,120,568 can perform the operation at base radius D shown in FIG. 23 and establish a precise thickness.

In FIG. 24 another preferred embodiment of the invention is shown having a tool 158 with abrasive elements 160 disposed on flanges 162 to control belt width. Elements 164 disposed on the ramps 166 form the grooves 168 in the ultimate workpiece such as the belt 170. In processing, the belt 170 is supported on an anvil 172. In this particular embodiment, tool 158 provides sizing for width through the precision dressed elements 160 and establishes a precision thickness through precision dressed elements 146 at the circumferential positions D as shown in FIGS. 9-17 and 23. The dressed elements 146 for thickness control at D-D are shown in FIG. 23 but are omitted in FIG. 24 for clarity. Circumferentially spaced elements 164 shown diagrammatically in FIG. 24 provide precision processing of the grooves 168 by the precision abrasive elements 164 on the ramps 166 at A-A, as previously described. Groove processing is provided in the continuum presented from D-D to A-A as represented at selected circumferential points by sectional views presented at B-B and C-C in FIGS. 16 and 17.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of removing material from an elongate non-metallic workpiece to produce an operative face with a tapered groove, a back face and opposed sides connecting said faces, said method comprising the steps of:

providing a supporting anvil adapted to support the back face of the workpiece and to move the workpiece longitudinally in a workpiece direction aligned with said groove;

providing an abrasive tool having a longitudinal working surface spaced from said anvil and adapted to engage said operative face and move in a working direction opposite the workpiece direction, said working surface having a base surface and an elongate ramp surface aligned with said groove, abrasive particles in a pattern on said ramp surface having a maximum width portion corresponding to the width of said groove and a narrowing continuum progressively in the working direction to an apex portion;

providing relative longitudinal motion between said anvil and said tool in the working direction; and reducing the space between said anvil and said working surface whereby said pattern of abrasive particles at said maximum width engages said workpiece followed by successively narrower portions of the pattern engaging the workpiece until the working face is completely formed.

2. The method of claim 1 wherein said workpiece is of a pliant material.

3. The method of claim 1 adapted for processing a workpiece that includes a plurality of side-by-side grooves wherein said tool includes a plurality of patterns corresponding to the grooves in the workpiece.

4. The method of claim 1 adapted for processing a driving belt workpiece with multiple parallel grooves, wherein said tool includes a plurality of patterns corresponding to the grooves.

5. The method of claim 1 adapted for processing a driving belt having reinforcing cords adjacent the back face thereof.

6. A method of removing material from an elongate non-metallic workpiece to produce an operative face with a tapered groove, a back face and opposed sides connecting said faces, said method comprising the steps of:

providing a cylindrical supporting anvil having a central axis about which it can be rotated and a cylindrical surface adapted to support the back face of the workpiece and to move the workpiece circumferentially in a workpiece direction aligned with said groove;

providing a cylindrical abrasive tool having a central axis about which it can be rotated and a cylindrical working surface spaced from said anvil and adapted to engage said operative face and move in a working direction opposite the workpiece direction, said working surface having a base surface and an elongate ramp surface aligned with said groove, abrasive particles in a pattern on said ramp surface having a maximum width portion corresponding to the width of said groove and a narrowing continuum progressively in the working direction to an apex portion;

rotating said anvil at a relatively slow rate and said tool at a relatively high rate to provide relative motion therebetween in the working direction; and reducing the space between said anvil and said working surface whereby said pattern of abrasive particles at said maximum width engages said workpiece followed by successively narrower portions of the pattern engaging the workpiece until the working face is completely formed.

* * * * *